United States Patent [19]

Hilfiker

[11] Patent Number: 4,661,023

[45] Date of Patent: Apr. 28, 1987

[54] RIVETED PLATE CONNECTOR FOR RETAINING WALL FACE PANELS

[75] Inventor: William K. Hilfiker, Eureka, Calif.

[73] Assignee: Hilfiker Pipe Co., Eureka, Calif.

[21] Appl. No.: 814,926

[22] Filed: Dec. 30, 1985

[51] Int. Cl.[4] ..... E02D 29/00

[52] U.S. Cl. ..... 405/262; 405/258; 405/284; 405/286

[58] Field of Search ..... 405/284, 285, 258, 262, 405/272, 273; 52/169.1, 169.9, 602, 586, 595; 403/206, 332, 242, 279

[56] References Cited

U.S. PATENT DOCUMENTS

| | | | |
|---|---|---|---|
| 2,994,162 | 8/1961 | Frantz | 52/595 |
| 3,111,060 | 11/1963 | Peeling | 403/206 |
| 3,922,864 | 12/1975 | Hilfiker | 61/35 |
| 4,117,686 | 10/1978 | Hilfiker | 405/284 |
| 4,154,554 | 5/1979 | Hilfiker | 405/273 |
| 4,266,890 | 5/1981 | Hilfiker | 405/262 |
| 4,324,508 | 4/1982 | Hilfiker | 405/284 |
| 4,329,089 | 5/1982 | Hilfiker et al. | 405/262 |
| 4,343,572 | 8/1982 | Hilfiker | 405/284 |
| 4,391,557 | 7/1983 | Hilfiker et al. | 405/284 |
| 4,448,571 | 5/1984 | Eckels | 405/284 |
| 4,470,728 | 9/1984 | Broadbent | 405/284 |
| 4,514,113 | 4/1985 | Neumann | 405/284 |

*Primary Examiner*—Cornelius J. Husar
*Assistant Examiner*—Anthony Knight
*Attorney, Agent, or Firm*—Limbach, Limbach & Sutton

[57] ABSTRACT

A retaining system for an earthen formation is disclosed. The earthen formation is reinforced against slippage by embedding an array of anchor members within the formation. The face of the formation is defined by a plurality of the elongated panels stacked in a vertical arrangement. The anchor members are secured to the panels via a support bar. The support bar includes an array of holes through which the ends of the anchor members are received and upset to define a rivet head. The support bars are engaged between the upper and lower edges of the face panels to provide support and maintain vertical alignment of the face panels.

11 Claims, 7 Drawing Figures

RIVETED PLATE CONNECTOR FOR RETAINING WALL FACE PANELS

TECHNICAL FIELD

The subject invention relates to a retention system for earthen formations wherein a wire array is embedded in the formation and secured to panels at the face of the formation.

BACKGROUND OF THE INVENTION

In the prior art, a number of retaining systems have been developed for earthen formations. An example of such a retaining system is shown in U.S. Pat. No. 4,324,508, issued Apr. 13, 1982. In this system, the location at which the earthen formation will be erected is first excavated. Thereafter, a reinforced structure is formed by assembling a plurality of stacked face panels to define a wall. Earth is filled in behind the face panels as they are stacked. Embedded within the formation are a plurality of grid work mats which act to reinforce the earthen formation. The mats are secured to the panels to aid in anchoring the panels against displacement and maintain the panels in a stacked aligned condition.

It should be understood that in this type of earthen formation the face panels are not intended to carry the load of the retaining system. This approach should be contrasted with other retaining systems known as anchor walls, where tie backs are secured to anchors, or embedded in bedrock behind the earthen formation, and secured to the face panels. In anchor walls, the face panels bear the stress of the earthen formation. Examples of such prior art tie back structures can be found in U.S. Pat. Nos. 3,922,864, issued Dec. 2, 1975, 4,154,554, issued May 15, 1979, and 4,266,890, issued May 12, 1981.

Other relevant prior art disclosures can be found in U.S. Pat. Nos. 4,117,686, issued Oct. 3, 1978, 4,329,089, issued May 11, 1982, 4,343,572, issued Aug. 10, 1982, and 4,391,557, issued July 5, 1983.

The subject invention is intended to be an improvement over the above discussed U.S. Pat. No. 4,324,508. The assembly system disclosed in the latter patent, wherein a wire grid mat is used to reinforce an earthen formation, has proven highly successful. As pointed out above, in this system, the mat is connected to the face panels. A number of approaches have been suggested to connect the wire grid mat to the face panels. In one embodiment, a plurality of pins are inserted between the upper and lower edges of adjacent face panels. The end of the mat to be secured to the face panels was folded over upon itself and inserted past the pins. A rod was then inserted into the folded portion of the mat creating an interengagement therebetween. In another approach, various connecting members such as loops were integrally formed with the face panels. These loops can be used to facilitate the connection of the wire grid to the face panel. For example, the ends of the wires of the grid can be passed through the loops and twisted. In a different technique, the grid is folded back upon itself and a rod is passed through both the grid and the loops embedded in the retaining wall.

All of the techniques for connecting the grid to the wall are effective to produce a satisfactory formation. However, the attachment methods are relatively complex, and a retaining system utilizing these techniques requires a significant time to assemble.

Accordingly, it is an object of the subject invention to provide a new and improved retaining system which can be more readily assembled.

It is another object of the subject invention to provide a new and improved retaining system having an improved means for connecting the anchor members forming the grid to the face panels.

It is a further object of the subject invention to provide a new and improved retaining system wherein the means for connecting the anchor members to the face panels is easy to manufacture.

It is another object of the subject invention to provide a new and improved retaining system wherein the means for connecting the anchor members to the face panels also functions to maintain the vertical alignment of the panels and provide a more uniform bearing surface against the panels.

It is a further object of the subject invention to provide a new and improved method for assembling a retaining system.

SUMMARY OF THE INVENTION

In accordance with these and other objects, the subject invention provides for a retaining system for an earthen formation. The system includes a plurality of elongated face panels which are stacked in a generally vertical manner to define a wall. A plurality of anchor members in the form of earth reinforcements are disposed within the earthen formation behind the stacked face panels. The anchor members may be in the form of a wire grid mat, as shown in U.S. Pat. No. 4,324,508. It is also possible that a parallel array of metal strips can be utilized.

In accordance with the subject invention, an improved means is disclosed for connecting the anchor members to the face panels. This means includes an elongated support bar having a plurality of holes for receiving the ends of the anchor members. In the preferred embodiment, the anchor members are secured to the support bar by upsetting the ends of the members projecting through the bar to form rivet heads. The support bars are then engaged between adjacent upper and lower surfaces of the stacked face panels.

In one embodiment of the subject invention, the upper and lower edges of the face panels are provided with tapered grooves for receiving the the support bar. This configuration enhances the engagement between the support bar and the face panels to maintain vertical alignment of the face panels and to evenly distribute the load across the length of the panels. By this approach, thinner face panels may be utilized.

In a second embodiment, the upper edge of each face panel is provided with slots for receiving the support bars. The lower edge of the face panels are then abutted against the rear surface of the support bars to create a stepped-type earthen formation.

Further objects and advantages of the subject invention will become apparent from the following detailed description taken in conjunction with the drawings in which:

DETAILED DESCRIPTION OF THE PREFERRED EMBODIMENTS

Figure 1:
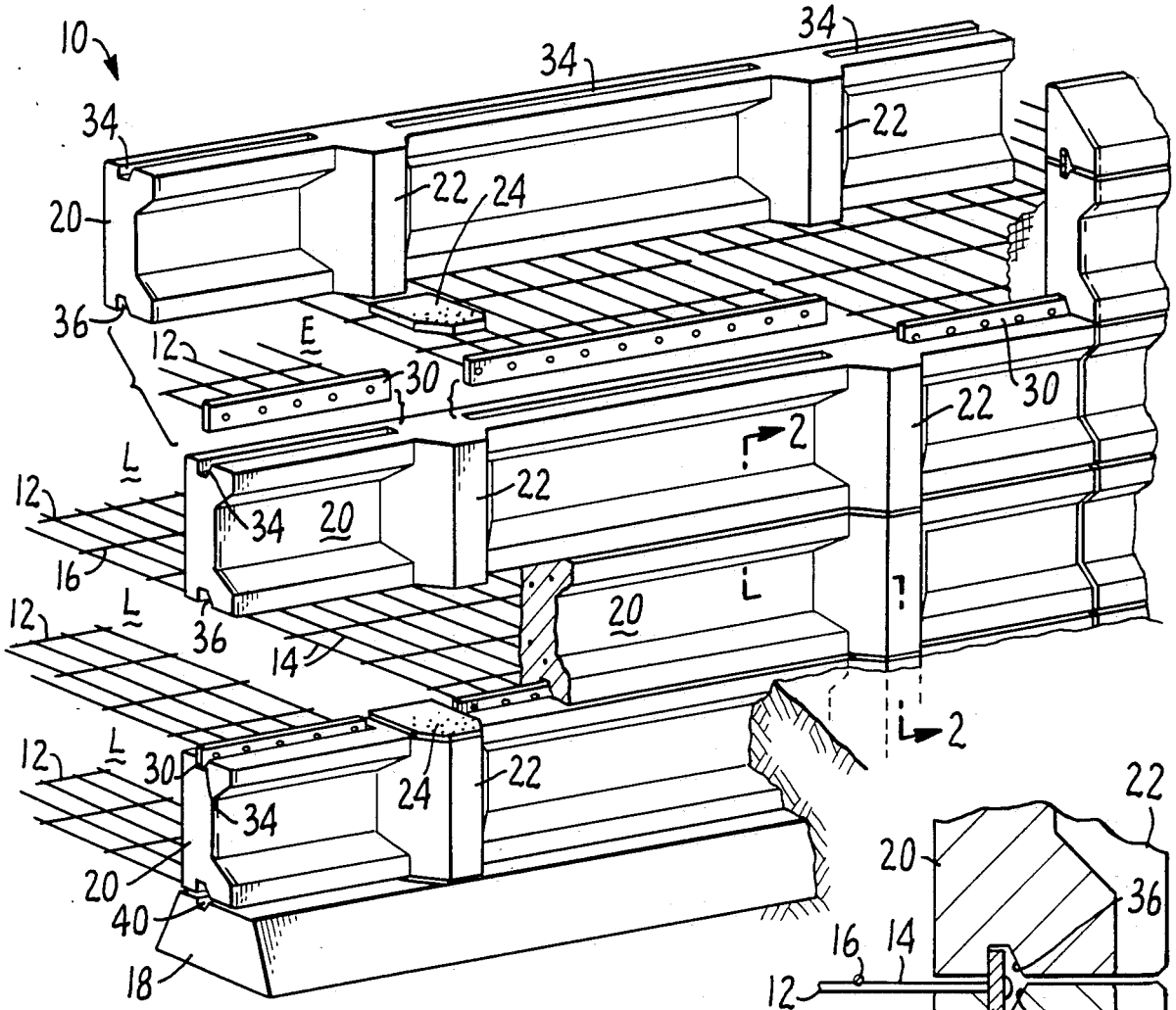
FIG. 1 is an exploded, perspective view, partially in section, of the retaining system of the subject invention.

Referring to FIGS. 1 through 4, there is shown a system 10 for reinforcing an earthen formation E. The earthen formation is broken up into horizontal layers L, typically having a height from two to three feet and having interposed therebetween reinforcing mats 12. The reinforcing mats are comprised of a plurality of elongated longitudinal anchor members 14, disposed in spaced-apart, parallel relationship. In the illustrated embodiment, the mats also include a plurality of cross members 16 which are welded to the members 14. The members 14 are spaced apart from 6 to 12 inches, while the cross members are spaced apart from 2 to 6 inches.

The earthen formation can also be reinforced by a parallel array of longitudinal earth reinforcing anchor members without the cross members. In this case, the anchor members are preferably formed with a wavy configuration for added stability.

The retaining wall is formed by vertically stacking a plurality of face panels 20 on top of a precast, leveling base 18. The face panels 20 are defined by precast concrete members having stacking enlargements 22 at spaced intervals therealong. The stacking enlargements 22 are provided to add structural rigidity to the assembly. Preferably, fiberglass bearing pads 24 are interposed between the stacking enlargements of adjacent upper and lower face panels to slightly space the panels.

In accordance with the subject invention, a new and improved means is provided for securing the members 14 to the face panels 20. In the preferred embodiment, this means is defined by an elongated support bar 30. The support bar is provided with a plurality of holes through which the ends of the members 14 are passed. The members 14 are preferably fixed in place by upsetting the projecting ends to form rivet heads. With this approach, no welds are necessary, such that the metal of the members 14 will not be weakened from the heat generated during a welding step. Each support bar may be on the order of 5 feet long, having a height of $3\frac{1}{2}$ inches and a width of $\frac{3}{8}$ of an inch. The thickness of the support bar can be increased, particularly where only a parallel array of earth reinforcing anchor members, unsupported by cross members, are used.

Figure 2:
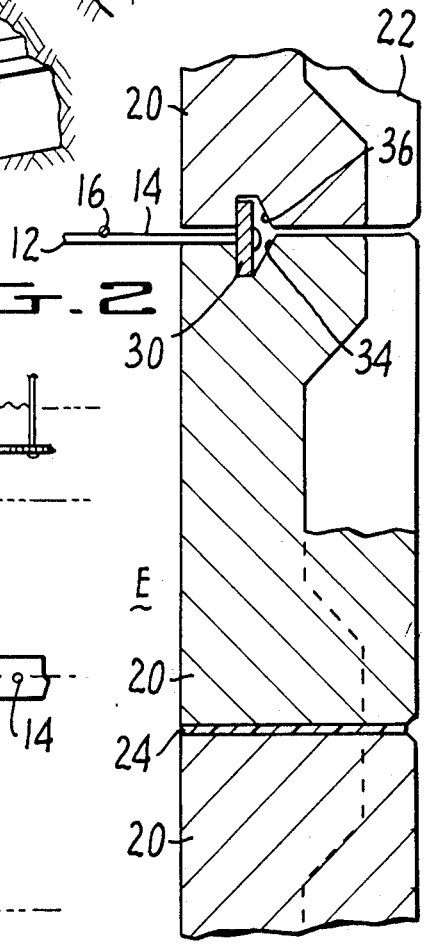
FIG. 2 is a partial cross-sectional view of the retaining system of the subject invention taken along the line 2—2 in FIG. 1.
Figure 3:
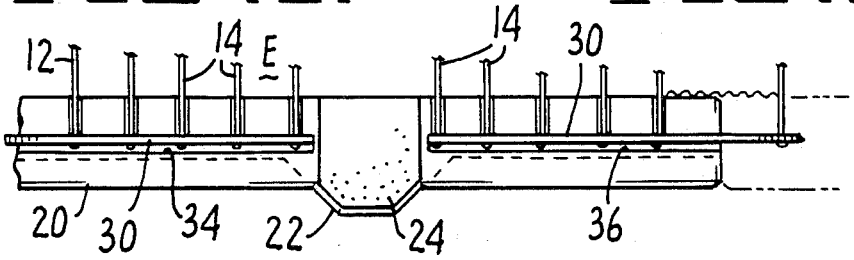
FIG. 3 is a top plan view of a face panel, illustrating an intermediate step in the assembly of the retaining system of the subject invention.
Figure 4:
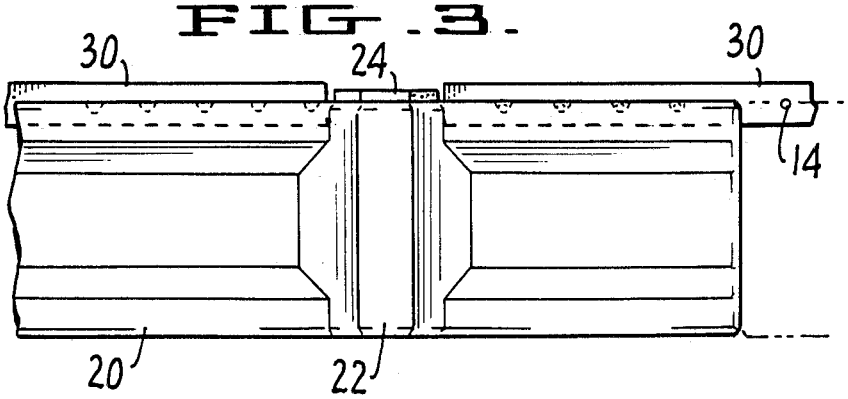
FIG. 4 is a side elevational view similar to FIG. 3 of the retaining system of the subject invention.

In order to facilitate the assembly of this structure, the upper and lower edges of the face panels are configured to engageably receive the support bar. As seen in FIGS. 1 and 2, the upper surface of each face panel 20 is provided with an elongated tapered groove 34 into which the lower edge of support bar 30 is received. Similarly, the lower edge of each face panel is provided with a complementary tapered groove 36 for receiving the upper edge of support bar 30.

Having described the elements of the subject system, its assembly will now be described. Similar to other reinforcing structures, the earthen formation is first excavated. Leveling base 18 is then laid. Preferably, base 18 includes a groove 40 similar to the groove 34 provided in the upper edge of each base panel 20. A mat 12 is then laid in a horizontal plane with the associated support bar 30 engaged with groove 40 in base 18. A face panel 20 is mounted on top of base 18 and earth can then be filled in behind the face panel.

Once the earth has been filled to the upper edge of face panel 20, another mat 12 is laid down with its associated support bar in engagement with the upper groove 36 of the face panel. Thereafter, the next row of face panels can be mounted with the fiberglass pads 24 interposed therebetween aligned with the stacking enlargements 22. This procedure is continued until the entire structure is formed.

From the foregoing, it should be appreciated that a relatively simple and quick means is provided for connecting the mats 12 to the face panels 20. The support bars also aid in maintaining the vertical alignment of the face panels. In addition, because of the elongated structure of the support bars 30, the load of the mats is evenly distributed along the front surface of the face panels, allowing the face panels to be made thinner than in the prior art.

Figure 5:
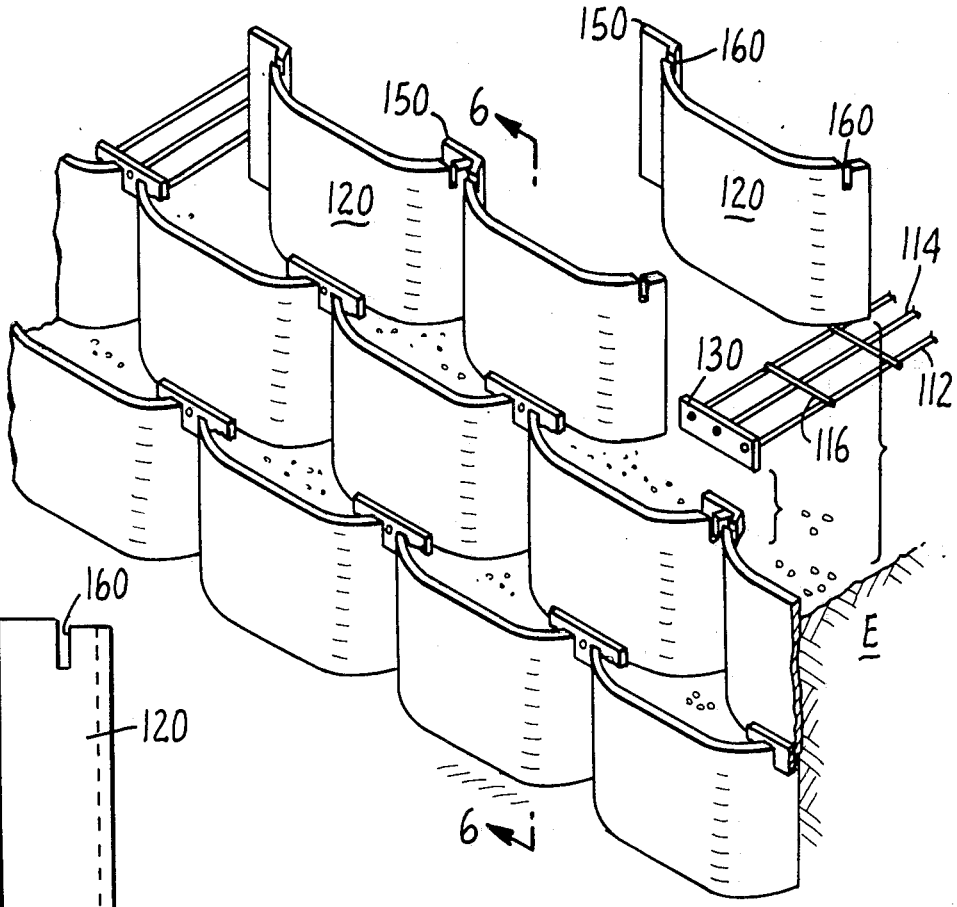
FIG. 5 is an exploded, perspective view of an alternate embodiment of the retaining wall system of the subject invention.
Figure 6:
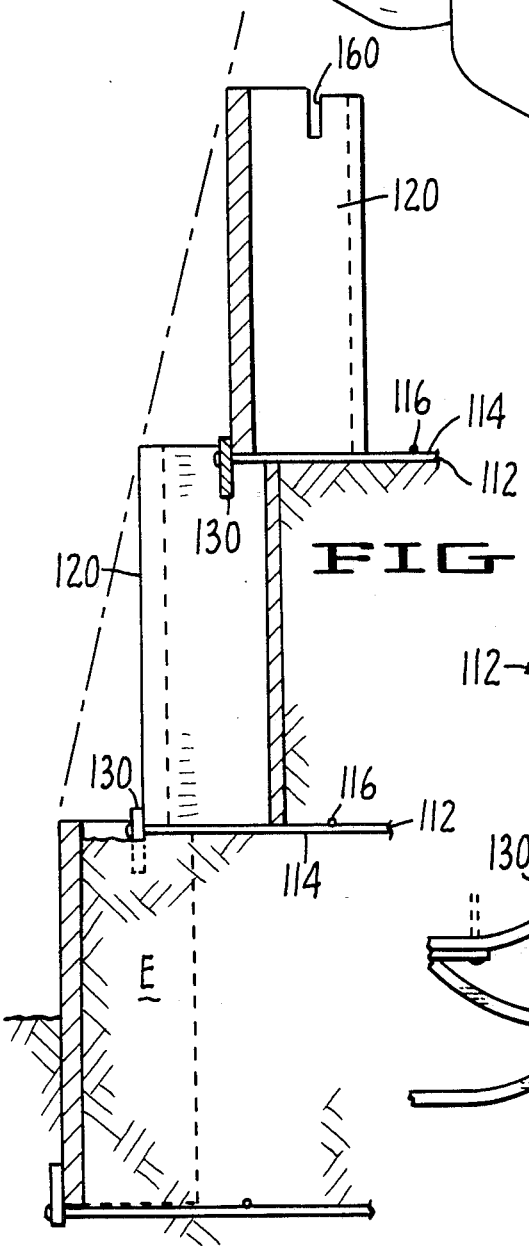
FIG. 6 is a side elevational view, partially in section, of the alternate embodiment of the retaining system of the subject invention.
Figure 7:
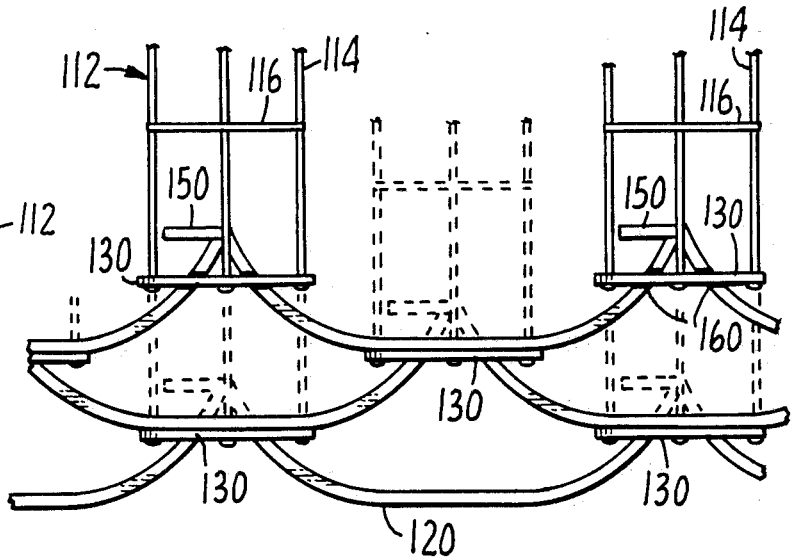
FIG. 7 is a top plan view, illustrating the assembly of the alternate embodiment of the retaining system of the subject invention.

Referring to FIGS. 5 through 7, an alternate embodiment of the retaining system of the subject invention is illustrated. This embodiment discloses a stepped-wall structure where the face panels are stacked vertically with each upper level being set back from the lower panel. The figures illustrate a 1 to 4 batter such that for every four feet of vertical height, the step is set back one foot, thereby providing an aesthetically pleasing appearance.

The primary differences between the first and second embodiments relate to the shape of the face panels and the interconnection between the support bars and the face panels. As with the first embodiment, a plurality of face panels 120 are provided. A plurality of horizontal mats 112 are embedded in the earthen formation E. The mats 112 include a plurality of spaced-apart longitudinal members 114 and cross members 116. The ends of the longitudinal members 114 are received in a support bar 130. As in the first embodiment, the support bar is provided with a plurality of holes through which the ends of the members 114 are passed. The end of each member 114 is upset to create a rivet head securing the members 114 to the support bars.

In the second embodiment of the subject invention, the elongated face panels are of a generally arcuate configuration. The panels are preferably formed from fiberglass or fiberglass reinforced concrete. One side edge of each panel includes a flange 150 which engages with the side edge of the adjacent face panel. This interengagement facilitates the alignment of the face panels.

The upper edge of each face panel further includes a pair of slots 160 located at the opposed ends thereof. Slots 160 are configured to receive the lower edge of support bar 130, as illustrated in FIGS. 5 through 7.

In order to create the stepped effect of this embodiment, each row of face panels is located behind the lower row. As illustrated in the figures, the lower edge of each face panel is abutted against the rear surface of the intermediate support bar 130. It should also be appreciated that the rows of face panels are staggered such that the central area of each face panel is aligned with the intersection of the two face panels immediately below. This approach allows for a stable structure to be erected.

The structure shown in the alternate embodiment can be erected quickly and requires no welding. The assembly steps are similar to the first embodiment. More specifically, a row of face panels is laid. Thereafter, earth is filled in behind the face panels and up to their upper edge. Mats are laid down in a horizontal manner with the support bars 130 engaged with the slots 160 of the associated face panels. The next row of face panels are then set back from the first, with lower edge thereof abutting the rear of the support bar 130. The process will continue until the wall is finished. The arcuate configuration of the face panels, combined with the staggered alignment of successive rows of panels permits the support bars to be engaged between upper and lower panels while creating the stepped effect.

In summary, there has been provided a new and improved retaining system for an earthen formation. The retaining system includes a plurality of elongated face panels stacked in a generally vertical manner. A plurality of anchor members are disposed within an earthen formation behind the stacked face panels. An improved means is provided for securing the anchor members to the face panels. This means is defined by a support bar having a plurality of holes through which the ends of the anchor members are received and upset to create a rivet head. The support bars are engaged between upper and lower edges of the face panels to support the face panels and maintain vertical alignment therebetween.

While the subject invention has been described with reference to preferred embodiments, it is to be understood that various changes and modifications could be made therein, by one skilled in the art, without varying from the scope and spirit of the subject invention as defined by the appended claims.

I claim:

1. A retaining system for an earthen formation comprising:

a plurality of elongated face panels stacked above one another to define a wall;

a plurality of anchor members disposed within the earthen formation behind the stacked face panels, said members being arranged in a spaced-apart generally parallel array; and a plurality of support bars disposed between and engaged with rows of face panels of said wall, at least certain of said support bars having an array of holes extending therethrough; and at least certain of said anchor members having ends extending through said holes and upset to secure the anchor members to the support bars.

2. A retaining system as recited in claim 1 wherein the upper edge of each face panel includes a means for engageably receiving said support bar.

3. A retaining system as recited in claim 2 wherein said means for receiving said support bar includes slots.

4. A retaining system as recited in claim 3 wherein the lower edge of the each face panel is butted up against the rear surface of said support bar.

5. A retaining system as recited in claim 2 wherein said means for receiving the support bar includes an elongated tapered groove.

6. A retaining system as recited in claim 5 wherein the lower edge of each face panel includes an elongated tapered groove for receiving a support bar

7. A retaining system as recited in claim 1 wherein said anchor members include earth reinforcing cross members.

8. A method of constructing a retaining system for an earthern formation comprising the steps of:

securing elongate earth anchor members to support bars by extending the ends of the members through holes in the bars and riveting the ends over;

laying successive rows of elongated face panels at the intended face of the formation in generally stacked relationship;

successively filling the area behind said rows of face panels with earth as said successive rows are laid;

successively laying said earth anchor members over said earth as it is successively filled, with said members being disposed in spaced apart generally parallel relationship and the support bars on said members captured between the stacked panels.

9. A method as recited in claim 8 wherein said anchor members are riveted to said support bars with the following steps:

providing an array of holes in each said support bar;

passing the ends of the anchor members through the holes in the support bar;

upsetting the ends of said anchor members to secure the anchor members to said support bar.

10. An improved retaining system for an earthen formation which includes a plurality of elongated face panels stacked above one another to define a wall and a plurality of anchor members disposd within the earthen formation behind the stacked face panels, said members being arranged in a spaced-apart array extending away from said face panels, with the improvement comprising:

elongated support bars secured to at least certain of said anchor members, said support bars being captured between said face panels and having arrays of holes through which ends of said certain anchor members extend; and upset heads on said ends to provide a riveted connection between said ends and bars.

11. A retaining system for an earthen formation comprising:

a plurality of elongated face panels stacked above one another to define a wall;

a plurality of anchor members disposed within the earthen formation behind the stacked face panels, said members being arranged in a spaced-apart parallel array; and a plurality of support bars disposed between and engaged with rows of face panels of said wall, each support bar having an array of holes into which one end of each anchor member is received, with the ends of said anchor members being upset to hold the anchor members in place.

* * * * *